US012070180B1

(12) United States Patent
Williamson

(10) Patent No.: US 12,070,180 B1
(45) Date of Patent: Aug. 27, 2024

(54) MANUALLY ROTATING STABILIZING WAND

(71) Applicant: Kathleen J. Williamson, East Stroudsburg, PA (US)

(72) Inventor: Kathleen J. Williamson, East Stroudsburg, PA (US)

( * ) Notice: Subject to any disclaimer, the term of this patent is extended or adjusted under 35 U.S.C. 154(b) by 480 days.

(21) Appl. No.: 17/517,610

(22) Filed: Nov. 2, 2021

Related U.S. Application Data

(63) Continuation-in-part of application No. 15/910,848, filed on Mar. 2, 2018, now Pat. No. 11,160,426.

(60) Provisional application No. 62/466,039, filed on Mar. 2, 2017.

(51) Int. Cl.
*A47L 9/24* (2006.01)
*A47L 9/06* (2006.01)
*A47L 9/32* (2006.01)

(52) U.S. Cl.
CPC ..... *A47L 9/248* (2013.01); *A47L 9/0606* (2013.01); *A47L 9/0693* (2013.01); *A47L 9/242* (2013.01); *A47L 9/327* (2013.01)

(58) Field of Classification Search
CPC ..... A47L 9/248; A47L 9/24; A47L 9/327
USPC ..... 16/110.1–114, 405–446
See application file for complete search history.

(56) References Cited

U.S. PATENT DOCUMENTS

| | | | | |
|---|---|---|---|---|
| 4,901,928 | A | 2/1990 | Abbott et al. | |
| 4,930,181 | A * | 6/1990 | Johnson | A01B 1/22 294/58 |
| 4,958,407 | A * | 9/1990 | Johnson | A01B 1/22 294/58 |
| 5,133,101 | A * | 7/1992 | Hauser | B25G 1/00 15/229.2 |
| 6,179,007 | B1 | 1/2001 | Cote | |
| 6,834,660 | B1 * | 12/2004 | Van Wart, Jr. | A61H 3/02 135/72 |
| 8,407,853 | B1 | 4/2013 | Baxt | |
| 8,453,296 | B2 | 6/2013 | Swerdlick | |
| 2008/0176723 | A1 | 7/2008 | Johnson | |
| 2011/0099765 | A1 * | 5/2011 | Youssefieh | A01D 7/00 15/147.1 |
| 2012/0048074 | A1 * | 3/2012 | Mosher | B25G 1/10 81/489 |
| 2017/0071433 | A1 | 3/2017 | Millington et al. | |

* cited by examiner

*Primary Examiner* — Bryan R Muller
(74) *Attorney, Agent, or Firm* — Wilkinson Law Office; Clinton H. Wilkinson

(57) ABSTRACT

A 360° manually rotating stabilizing wand for use in combination with a vacuum dusting attachment to improve the ease of use of the dusting attachment comprising a wand member having an interior suction channel and a coupling nozzle connected to opposite open ends of the wand member, a handle assembly mounted to the wand member including a first handle component and a second handle component connected at spaced-apart, offset locations on the perimeter of the wand section along the longitudinal axis of the wand section, forming two pairs of offset handle gripping portions spaced outwardly from the wand member and forming a partial helical configuration around the wand member.

16 Claims, 9 Drawing Sheets

MANUALLY ROTATING STABILIZING WAND

FIELD OF THE INVENTION

The present invention relates generally to attachments and accessory tools for household vacuum cleaners, and more particularly to a multi-chambered ergonomic vacuum dusting attachment including a crevice tool and a dual use detachable cap end and swivel nozzle, as well as a 360° manually rotating stabilizing wand, and an independent adjustable accordion hose attachment.

BACKGROUND OF THE INVENTION

Suction-type surface cleaning appliances such as vacuum cleaners for cleaning floors, upholstery, and other areas in a home or workplace are generally known. The most popular household vacuum cleaners are either upright-standing or canister-style vacuum cleaners, although other more specialized types such as handheld vacuums, central air vacuum systems, electric brooms, and shop vacuums are also available. Household vacuum cleaners typically include a primary electrically motorized surface cleaning component for cleaning floor areas. Traditional upright standing vacuums have a separate hose extension for alternately connecting vacuum attachments, while in canister-type vacuums, typically the surface cleaning component is connected by a rigid conduit to a handle, which handle in turn is connected to the suction unit or canister by a flexible hose, such that the surface cleaning component and rigid conduit can be detached from the hose and handle and used with other vacuum attachments. In both vacuum types, the hose and the vacuum attachments thereby are used to collect dirt, dust, and debris that cannot be reached and/or collected by the primary electrically motorized surface cleaning component.

The usual assortment of single purposed vacuum dusting attachments provided with the purchase of a vacuum cleaning machine are a crevice tool, a small bristled dusting tool, a small brushless dusting tool, and a wider bristled dusting tool suitable for larger surfaces such as wood flooring. Additional rigid extension hoses may be purchased as well. The manufacturers of the vacuum cleaning machines usually try to accommodate a storage place for the originally supplied vacuum dusting attachments, but Consumers often purchase additional purposed attachments since the attachments provided with the purchase are not adequate for all cleaning purposes. For example, a Consumer may purchase an additional attachment with swiveling or angled features to clean the upper surface of a ceiling fan. When the Consumer actually is in the process of vacuuming, these attachments have to be transported around while cleaning, it takes time for the Consumer to change the different attachments out to solve different dusting chores, and a place to store the additional vacuum attachments while not in use is required. Ideally, vacuum dusting attachments would be created which would sufficiently serve several purposes within one attachment, which would eliminate storage, the transport of many, and reduce the time it takes to change out the attachments while in the process of cleaning.

While the Consumer is engaged in cleaning, problems are encountered particularly where close up cleaning is desired, especially when the hand has to hold the attachment in cleaning, such as when cleaning the top surface of a couch cushion. The Consumer is now forced to try to vacuum with vacuum dusting attachments that do not provide any place for the Consumer to comfortably hold the attachment. The Consumer therefore must hold on to an oddly shaped attachment or wrap their hands around a hard-circular extension or coupler hose, usually with the hand holding the uneven area where the attachment's end nozzle is attached to the hard coupler of the hose that originates out of the vacuum. The vacuum dusting attachments available on today's market are awkward to use and have no flexibility in movement where the Consumer has to use their own motions of wrist, hands, and body to move the attachment. Further, those who have afflictions such as osteoporosis, carpal tunnel, or such, may experience significant pain. In frustration, a Consumer will then switch to dusting with other devices at hand, such as rags, spray cleaning applications, and feather dusters, of which most of the dust escapes into the surrounding environs while creating additional items to carry while cleaning. This problem also arises when additional hard extension hoses are added between the vacuum attachment and the vacuum cleaner while trying to dust areas too far to reach such as high ceilings and tops of furniture. Now the Consumer encounters an attachment at a distance where the vacuum attachment's open aperture is hard to maneuver into the correct position, and also is faced with moving a rigid hose/s into position. It might necessitate the Consumer to bring the whole assembly of attachment and hoses back down towards them in order to adjust the vacuum attachment into another position or proper angle, especially since the aperture's one opening is usually quite small in size. Further, the Consumer while using rigid extension hoses has to overcome the limitations set by the standard length of the hoses and their non-movement except in one direction. The hose length when too short or too long is more likely to cause accidents such as, for example, the Consumer falling off a chair trying to compensate for hose shortness, or backing up too far and falling backwards down a flight of stairs to compensate for a hose being too long.

Another problem with vacuum dusting attachments on the current market is that mostly there is non-existing or inadequate lighting incorporated in the individual attachments themselves which would facilitate better seeing the dusting area to be cleaned, especially areas that are in shadow such as behind other items on a shelf, or the reduced lighting due to the time of day. Usually only the motorized primary surface cleaning component is complemented with lighting to light up the area directly in front of it to be vacuumed which primarily is the floor area, but it would especially be an advantage to have peripherally overall lighting on an attachment to be able to see all surrounding areas that are being vacuumed, thus speeding up and improving the cleaning process. The advantages of including lighting on an attachment itself are twofold, as it lights up the area to be dusted, and the emitted lighted beams allow the Consumer to actually see and confirm that the dust nodes/particles are being sucked up into the vacuum attachment. Unfortunately, because of the lack of proficient lighting on vacuum attachments, a Consumer might devise to precariously place a lamp closer to an area, or employ the uncoordinated use of a flashlight to obtain the same results.

Since the majority of the vacuum dusting attachments on the market today are designed to provide one specific cleaning chore, such as for example, a crevice tool for the sides of cushions, brushes affixed on a vacuum attachment to vacuum the top of the cushions, and a brushless vacuum attachment for drapery cleaning, and so forth, the Consumer is tasked with additional cleaning time to change out different attachments for each cleaning chore, use physical expenditure in repeated movements to collect debris owing to a small aperture attachment, transport many vacuum dusting attachments, suffer uncomfortable use of the vacuum dusting attachments due to the lack of proper hand holds, and insufficient lighting, causing vacuuming with vacuum dusting attachments to become a frustrating, sometimes painful, time consuming and undesirable chore.

BRIEF SUMMARY OF THE INVENTION

It is a primary intention of the present invention to provide in an embodiment a superior amalgamated vacuum dusting attachment that will replace three individual standard vacuum attachments: a pull-out/push-in crevice tool, a bristled brush tool with 360° rotating wheels and lighting, and an optional detachable brushless tool with a back end swivel nozzle with lock, while also providing a comfortable place for the Consumer to hold the attachment while engaged in close up dusting/cleaning, and an additional recharging pin port for optional recharging capabilities. Further it is another primary intention to provide the amalgamated vacuum dusting attachment in an embodiment with more flexibility in movement by use of two separately devised attachments: a 360° manually rotating stabilizing wand with handles that have one or both end nozzles swiveable, and a flexible accordion hose.

In accordance with the present invention as featured in the Figure drawings, a computer mouse-like hand held vacuum attachment is devised. The vacuum attachment can be used by holding the top when close up cleaning is desired or attached on to hose extensions to clean distant areas. When the vacuum attachment is used for close up cleaning, the Consumer's hand can hold comfortably onto an ergonomically shaped top padded with non-slip material. The attachment moves with the hand by use of 360° wheels provided where the wheels also provide height and less resistance as the brushes below sweep debris. While trying to reach tight narrow spaces, the crevice tool which has its own intact vent, can be pulled out for use. When for example drapery needs to be cleaned the back brushless cap can be detached. The vacuum attachment provides lighting to the cleaning area with two battery powered light fixtures activated by an on/off switch, of which the battery has the option to be recharged through a rechargeable pin port. When a brushless vacuum attachment is required, the back cap may be detached and used. The back end features a swivel nozzle which allows freedom of swinging motion as the Consumer cleans, and added distance is provided with the accordion hose attached. When the Consumer needs to place the attachment to a hose in a stationary position for distance cleaning, the swivel option can be locked, and the accordion hose may be bent, and along with the manually rotating stabilizing wand the attachment and its open aperture can be positioned where needed for cleaning. All three devices would benefit if their construction featured an embodiment of an outer, or interior, or within their walls and handles a coefficient conductive material that was incorporated with a semiconductive material that would transmit electrical power from a dedicated vacuum cleaning unit for powering the attachment's lights or other amenities.

Further, it is intended that when the vacuum dusting device is being used at a distance when attached to an extension hose, preferably to the accordion hose presented, both the vacuum dusting device and accordion hose/s can be easily leveraged, stabilized and maneuvered by using the 360° manually rotating stabilizing wand placed at the bottom of the assembled parts. Then the swivel nozzle of the wand designated to connect to the output hose of the vacuum unit can be locked or unlocked to provide the unnecessary tangling of any hoses or wands below the manually rotating stabilizing wand, whether or not if the vacuum unit has a swiveling base of vacuum's output hose.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

DETAILED DESCRIPTION OF THE INVENTION

The following detailed description is of the best mode or modes of the invention presently contemplated. Such description is merely exemplary in nature and is not intended to be understood in a limiting sense, but to be an example of the invention presented solely for illustration thereof, and by reference to which in connection with the following description and the accompanying drawings one skilled in the art may be advised of the advantages and construction of the invention.

Figure 1:
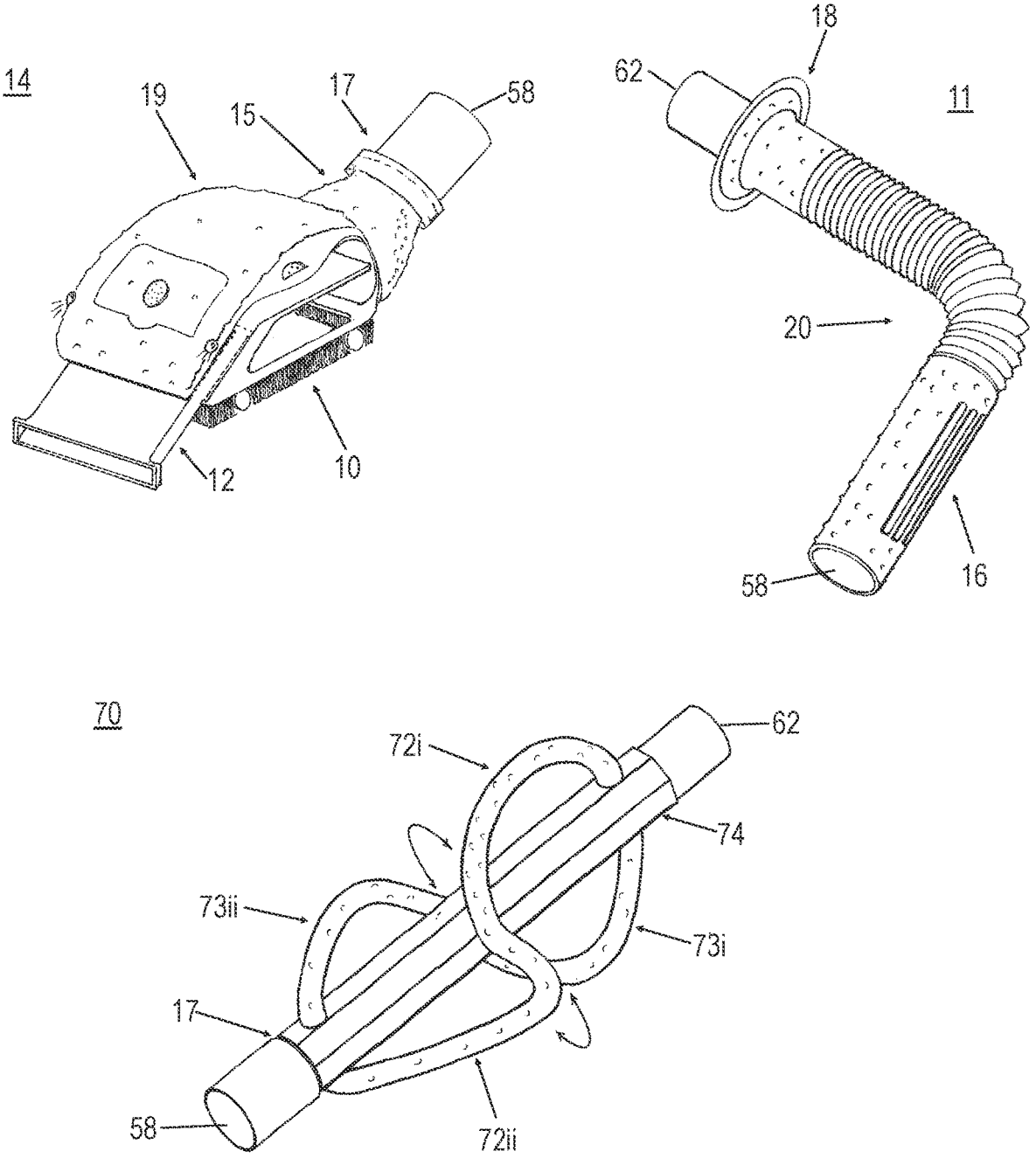
FIG. 1 is a perspective view of a vacuum dusting attachment, optional use accordion hose vacuum attachment, and a 360° manually rotating stabilizing wand according to the present invention.

In accordance with the present disclosure, FIG. 1 illustrates preferred embodiments of a multi-chambered ergonomic vacuum dusting attachment, a 360° manually rotating stabilizing wand, and an independent adjustable accordion hose attachment in accordance with the present invention. FIGS. 2-8 illustrate embodiments of the vacuum cleaner dusting attachment device 14 which is comprised of a plurality of joining pieces 10, 12, 15, 17, and 19 as described in more detail below, but may include other alternated versions having additional and/or fewer parts and in different combinations of unitary constructions as shown but not limited to the alternate versions illustrated in FIGS. 7 and 8. FIGS. 9A-C and 10A-D illustrate the manually rotating stabilizing wand 70 comprising a rigid conduit wand section 74 enclosed between coupling nozzles 58 and 62, and two double handle components 72A, B, C and 73D, E, F connected to and extending outwards of wand section 74, forming a 360° circumferential and lengthwise spiraling-like spanning array of four individual offset handle portions 72*i*, 72*ii*, 73*i*, and 73*ii*. FIG. 11 illustrates a preferred embodiment of the accordion hose vacuum attachment 11 in both a collapsed 20 position for carrying and storage, and in an expanded position 21 where the accordion hose can be extended and bent into position for best cleaning of distant areas.

Figure 6:
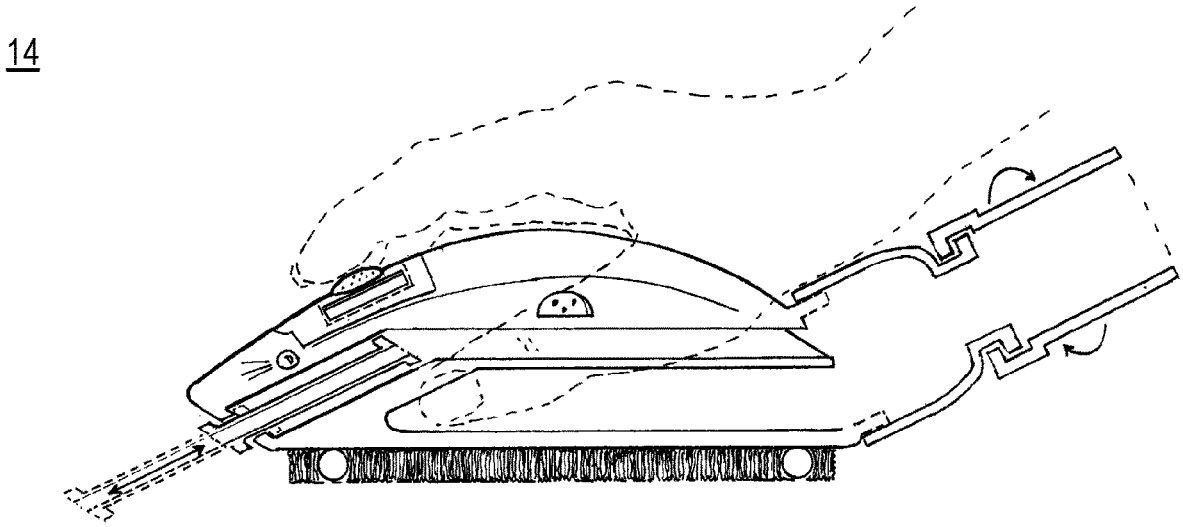
FIG. 6 illustrates in phantom lines a Consumer's hand gripping the vacuum dusting attachment with the palm resting on the front portion and the back of the wrist leaning on the cap end.

Referring now in particular to FIGS. 1-6, an embodiment of the vacuum dusting attachment 14 in accordance with the present invention is shown, which includes a main body comprising a cleaning portion 10, an extendable and retractable crevice tool 12, a cap end component 15, an intake swiveling coupling nozzle 17, and an ergonomically shaped upper portion 19. In FIG. 1 vacuum dusting attachment 14 is shown fully assembled to form a housing except for a portion of the side wall panel which is removed in the illustrations for viewing the interior of the device. Detachable cap end component 15, shown detached in FIG. 2, may be used as a separate cleaning attachment when detached from the front portion of dusting attachment 14. In FIG. 3A the approximate measurements of an embodiment of the vacuum dusting attachment 14 convey that the attachment 14 is sized and the outer surface of upper part 19 is curved and ergonomically shaped to accommodate the hand naturally for holding in a manner similar to a computer mouse in that, as illustrated in FIG. 6, a Consumer has complete hand control of the attachment while used in close up cleaning, but can also be used for distance cleaning while attached to other vacuum extensions (FIG. 1). The vacuum dusting attachment 14 therefore is ergonomically designed for comfort. FIG. 3B shows the underside of the cleaning portion 10 of the dusting attachment 14 which has an open bottom aperture 42 that leads to lower vent 50, and the position of wheels 55 and brushes 56 of the cleaning portion 10 spaced around the periphery of aperture 42.

Figure 4:
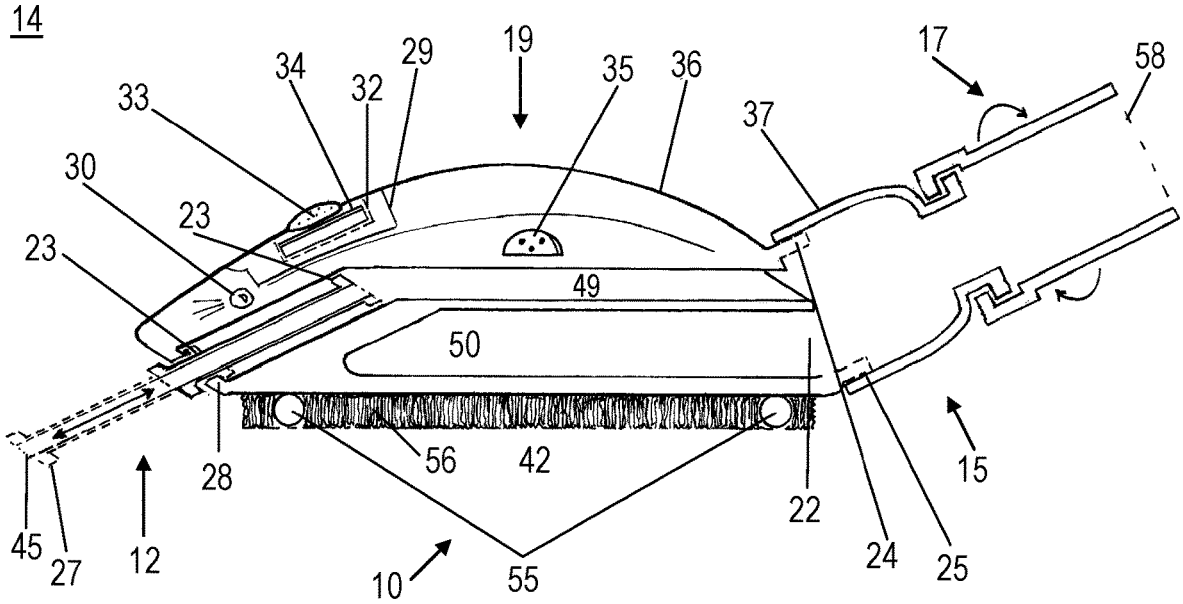
FIG. 4 is another side sectional view identifying individual features of the vacuum dusting attachment.
Figure 5:
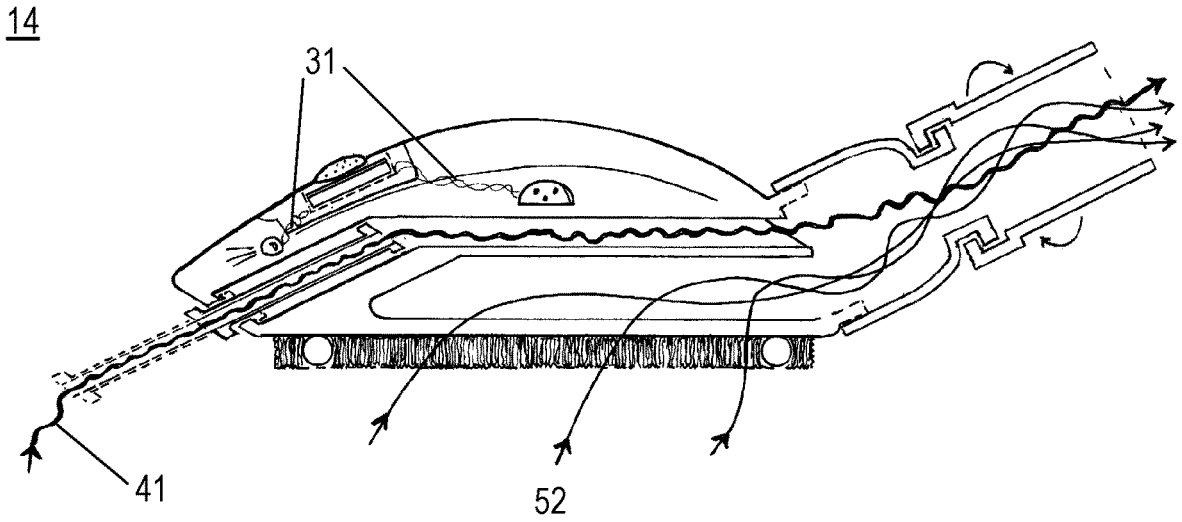
FIG. 5 is another side sectional view illustrating the direction of debris air flow through the vacuum dusting attachment vents.

As presented in FIGS. 1-6 the front or forward portion of vacuum dusting attachment 14 which includes cleaning portion 10, crevice tool 12, and top portion 19, (see FIG. 2) in itself comprises a plurality of parts. Pull-out/push-in crevice tool 12 is movably secured in a downwardly angled section of a dedicated enclosed vent or air channel 49 as seen in FIG. 4 which vent 49 provides a first suctioned air path in attachment 14 where debris is suctioned in to vent 49 through the open vent 45 of the crevice tool 12 and which is facilitated through the suction created from a vacuum receptacle vacuum dusting attachment 14 is attached to and/or other various other attachments in-between leading to the vacuum receptacle. The dirty air inlet or vent 45 of the crevice tool 12 collects debris whether the crevice tool 12 is in a fully extended or pulled-out position, a fully retracted or pushed-in position, or an intermediate position. Tabs 27 are situated on the outside of the crevice tool device 12 and internal rear tabs 23 are provided at the opposite end of the device 12 in vent 49, and along with the interior tabs 28 which are located on the outer shell of the front side of the vacuum dusting attachment 14 where the crevice tool 12 operates, vacuum suction leakage around the edges of the crevice tool 12 is prevented while tabs 23 prevent the crevice tool 12 from completely sliding all the way out from the interior vent chamber 49. A means for securing the crevice tool 12 in an extended or retracted position, not shown, may also be provided and may be in the form of a notch in the wall of the air channel 45 for receiving interior tabs 28 when slidably moved over the notch, or alternatively another suitable locking means may be provided. It might be desirous in an embodiment to attach a screen that covers the front aperture opening 45, but most large debris will be prevented from entering into the narrow opening 45 of crevice tool 12 in vent 49, and if need be, any lodged debris that enters the vent chamber 49 can be removed from the vent at backside opening 22 of the forward portion of device 14 when the forward portion of the vacuum dusting attachment 14 is disconnected from the rear cap portion 15.

Providing tabs 23 and 27 on the opposite ends of the crevice tool 12 and corresponding interior tabs 28 on the front of the vacuum dusting attachment 14 as shown in FIG. 4 necessitates in an embodiment that the forward portion of the device 14 be manufactured in separate pieces. The top area 19 of the forward portion of attachment 14 most likely will be manufactured as one such piece of a solid hard plastic or other suitable material which provides the amount of stability required to allow recessed areas for battery chamber 32 to be formed, a corresponding chamber lid cover 29 with push on/off button 33 added (conveniently located in the center similar to a computer mouse wheel (FIG. 6), open channels for wiring 31 (FIG. 5) to connect the battery 34 to light fixtures 30 on the outer front sides of the forward portion of device 14, an alternate energy recharge pin port 35, and to provide support for a Consumer's hand (FIG. 6). This solid manufactured piece would allow insertion of the crevice tool 12, as well as forming the upper wall of the top vent opening 49. The upper portion 19 and respective side walls would then be attached to the lower cleaning portion 10 to complete the forward portion of the vacuum dusting attachment 14. Ideally, the very top surface of upper portion 19 is coated with a padded and textured soft coating 36 including but not limited to a thermoplastic rubber (TPR), polypropylene (PP), or other polymer or rubber material for the comfort of the Consumer's handling of the device while in use. This padded and textured soft coating 37 would also be applied to the top surface of cap end 15 so that it is also comfortable in the Consumer's hand when gripped and used as separate suction tool, as well as applied to the accordion hose handles and handles of the 360° rotating stabilizing wand.

Debris is also collected by the vacuum dusting attachment 14 from the bottom cleaning portion 10 through aperture opening 42. This open area of the cleaning portion 10 of the vacuum dusting attachment 14 includes a separate vent 50 from the crevice tool vent 49 (see FIG. 4) which by being separated the two individual vents 49 and 50 create a stronger suction power at each vent opening. As debris is collected through both vents 49 and 50 within the vacuum dusting attachment 14, the debris commingles as it exits both vents and continues in and through the cap end 15 of attachment 14 and through to the vacuum receptacle. This collection of debris through the two vents 49 and 50 is indicated by the debris flow lines 41 and 52 in FIG. 5 through their respective vents.

Referring again to FIG. 4, the cleaning portion 10, or bottom portion, of the vacuum dusting attachment 14 and the forward portion, the cleaning portion 10 is also a combination of a plurality of parts. When connected to the upper portion 19, the bottom of vent 49 is now enclosed and forms a top and a base for vent opening 50 while also forming the aperture opening 42 beneath the vent 50 opening (see FIG. 3B). Along the base of the aperture opening 42 and opening of vent 50, brushes 56 are placed extending outwardly along the lower outer edges of the base surrounding the aperture opening 42 to loosen and gather debris off of surfaces to be cleaned using the dusting attachment 14. Since the vacuum dusting device 14 would mostly be used while being grasped or held in a Consumer's hand and corresponding hand pressure, wheels 55 that can rotate 360° while the Consumer presses slightly downwards while cleaning are advantageously provided in a spaced apart fashion along the lower edge of the base, of which the wheels 55 will also help in keeping the vacuum dusting attachment 14 at a correct height to collect debris. The wheels 55 would ideally be of a soft TPR material to prevent scratching delicate surfaces.

When the forward portion of the vacuum dusting attachment 14 is fully assembled, a back opening 22 is created as shown in FIG. 4 that combines the distal ends of vents 49 and 50. The back opening 22 extends outwards to allow the cap end 15 to attach to the forward portion of the vacuum dusting attachment 14. More particularly, the ends of the two pieces 14 and 15 attach together at points 24 on the outer side of the now formed circular back end of the forward portion of the vacuum dusting attachment 14 to the inner end 25 of the circular cap end 15 (FIG. 2), preferably both connection areas 24 and 25 couple together by using a short screw thread coupling method due to pressures that might cause the cap end 15 to become detached when the vacuum dusting attachment 14 is used as a whole unit.

Figure 2:
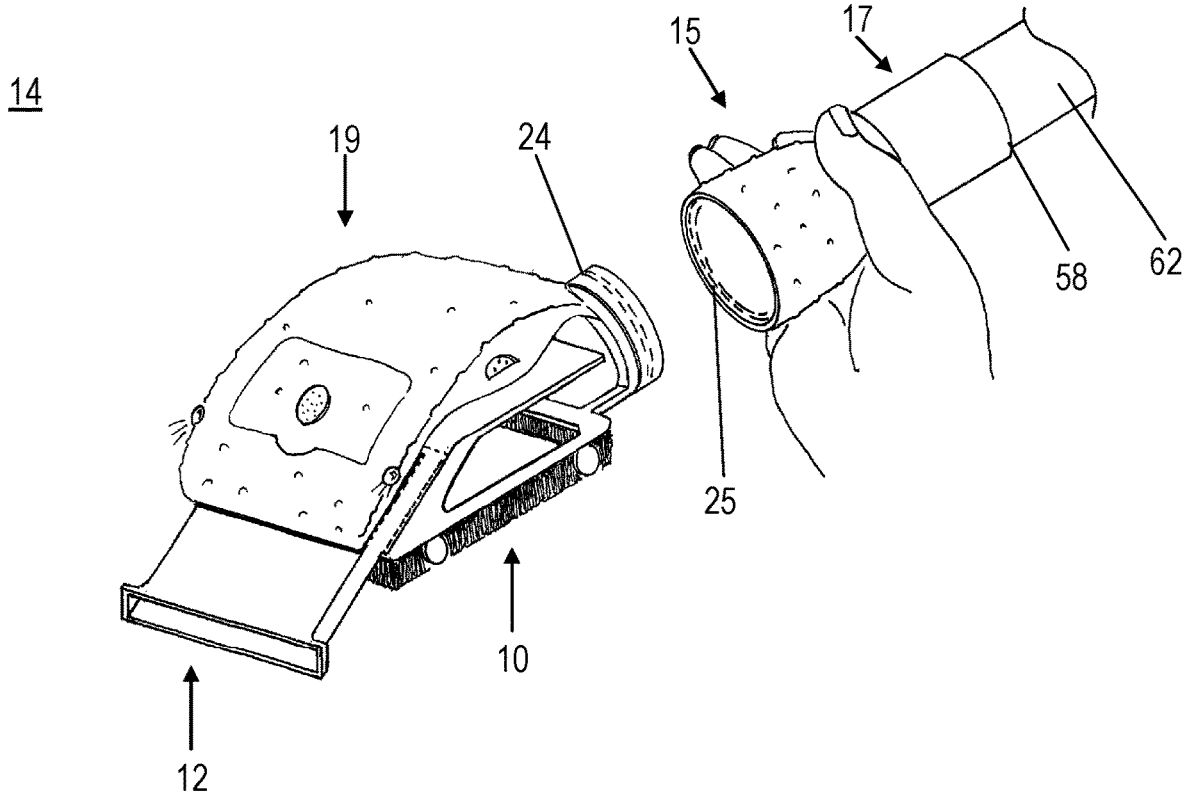
FIG. 2 is another perspective view of the vacuum dusting attachment with a side panel removed for illustrative purposes and with the cap end detached from the front portion of the attachment.
Figure 3:
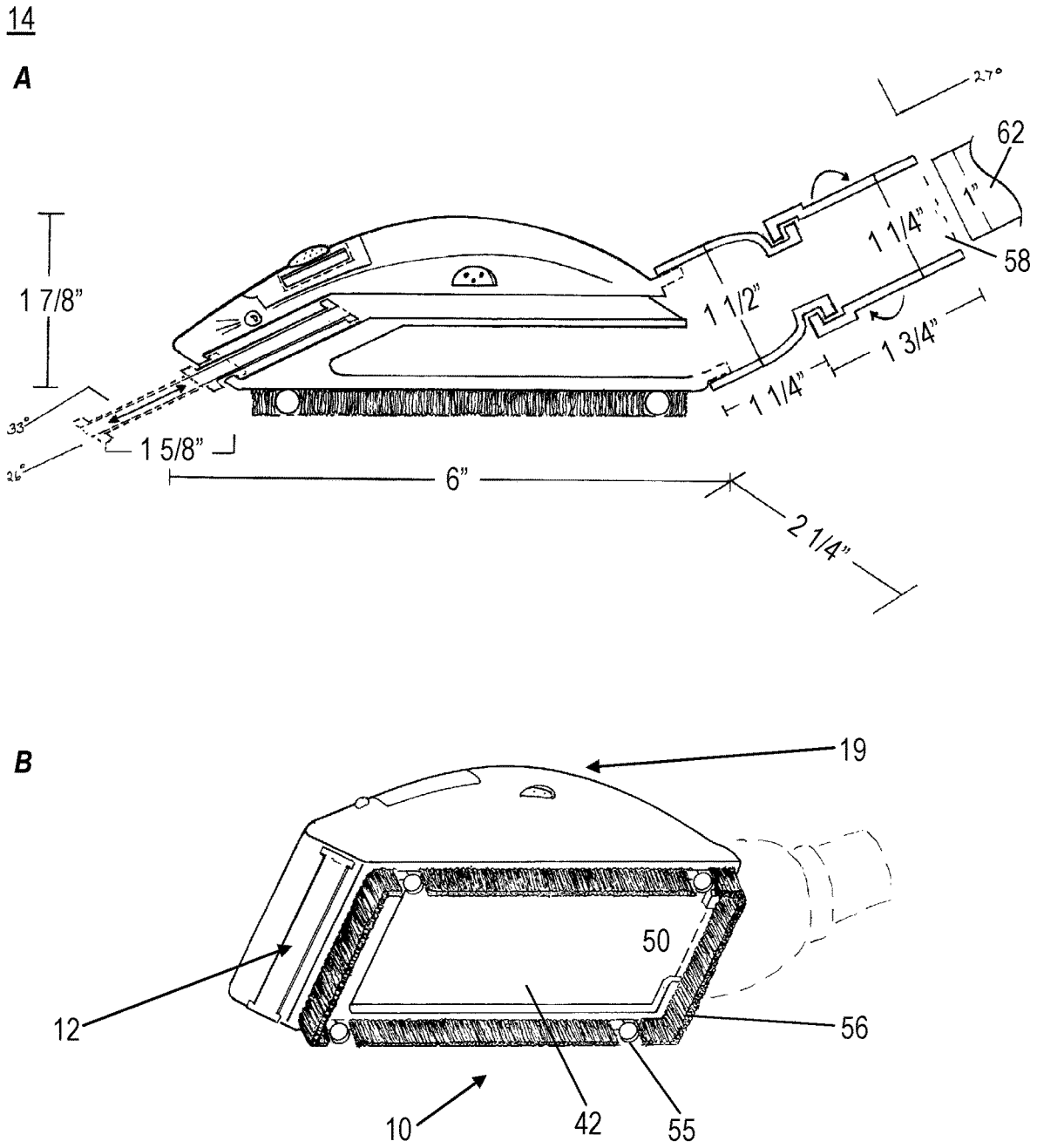
FIG. 3A is a side sectional view of the vacuum dusting attachment showing the approximate measurements of an embodiment of the attachment
FIG. 3B is a perspective view from the bottom showing the underside of the front portion of the vacuum dusting attachment.
Figure 8:
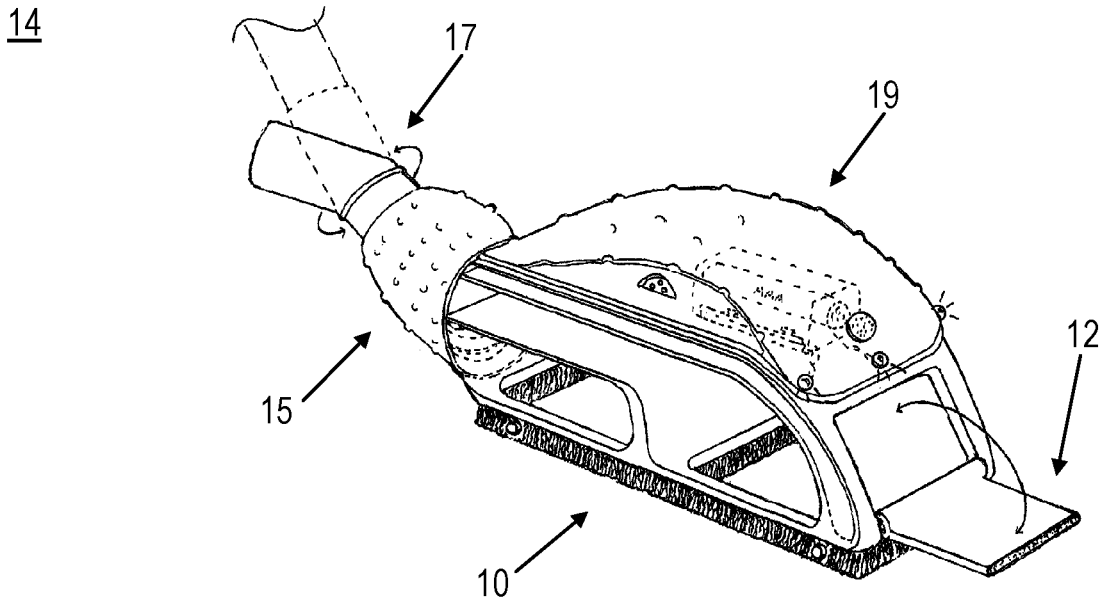
FIG. 8 illustrates another alternate version of the vacuum dusting attachment having a flip out crevice tool, three separate intake vents, and an angled bent swiveling intake hose end.

The cap end 15 becomes a third purposed vacuum dusting attachment when detached from the forward portion of the vacuum dusting attachment 14. Used in various ways, the vacuum dusting attachment 14 replaces a vacuum crevice tool, a brushed tool device, and the cap end becomes a brushless tool device when detached as shown in FIG. 2. The back side of the cap end 15 couples internally with an intake hose end 17, of which other vacuum attachments can be attached by inserting their input side hose end 62 into the intake coupling nozzle end 58 of device 14 (FIG. 2). The swivel mechanism 17 allows hose end 17 to spin or rotate in any direction while attached to another hose attachment as indicated by arrows in FIG. 4. A similar arrangement is shown in FIG. 8 where an alternate version of device 14 comprises an end hose 17 that has a slight bend allowing for more swiveling movement. This swiveling section of end hose 17 also will include a locking system (not shown) incorporated to lock it in a desired position against swiveling, the details of which locking system will be determined in manufacture production process, especially since this swivel/locking type mechanism is already prevalent throughout the vacuum industry. It is preferable that all separate attachments are designed to be compatible such that the smaller or insert hose ends 62 fit correctly within the larger intake ends 58 of end hose 17 as indicated in several of the Figures.

Figure 7:
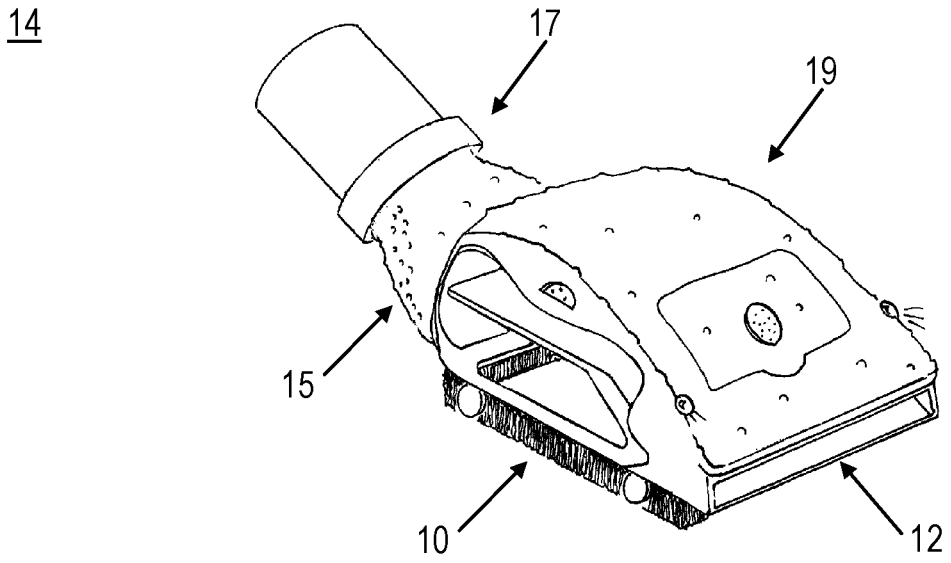
FIG. 7 illustrates an alternate version of the vacuum dusting attachment in which the pull out/push in crevice tool is eliminated and the front end is slightly elongated as it protrudes out from the attachment body.

FIGS. 7 and 8 present alternate arrangements of the vacuum dusting attachment 14, but it will be understood do not limit other arrangement possibilities. In FIG. 7 the vacuum cleaner dusting attachment is shown having a crevice opening 12 that slightly protrudes from the forward end of the attachment, but does not including an extending and retracting crevice tool as in the previous embodiment. In FIG. 8 the vacuum cleaner dusting attachment is provided with a flip-open crevice tool 12 on the forward end of the body section, which when in an open position provides a dirty air inlet to a dedicated suction channel as in the previous embodiment. In addition, the bottom opening in the dusting attachment is divided laterally into a forward and rearward opening also having separate dedicated suction channels. Thus, the dusting attachment in FIG. 8 features three separate dust collection vents in the cleaning portion 10.

FIGS. 1, 9A-C and 10A-D illustrate another vacuum attachment which can be used in combination with the dusting attachment 14 and independent adjustable accordion hose attachment 11, as well as other vacuum devices, or converted for other markets, in the form of a preferably straight, hollow rigid 360° manually rotating stabilizing wand 70. This vacuum attachment wand 70 comprises a rigid conduit, or extension wand member 74, enclosed between or connected on opposite open ends to an intake coupling nozzle end 58 and an inserter coupler nozzle end 62. Extension wand member 74 comprises an interior channel which is in fluid communication with a vacuum suction force when coupled to a vacuum unit connection hose on intake coupling nozzle end 58. It will be understood that coupling nozzle 58 may include an intake coupling nozzle end, an inserter coupler nozzle end, or other suitable nozzle configuration depending on the type of connection required to connect to a particular vacuum connection hose. Depending on the type of vacuum unit used, such as for example a unit which lacks a swiveling base where the vacuum's connection hose extends out from the vacuum, the manually rotating stabilizing wand 70, might necessitate in an embodiment that one or both of the designated attaching nozzle end 58 and/or 62 of the 360° manually rotating stabilizing wand 70 that connects to the vacuum's output hose, be equipped with a rotatable or spinning nozzle (FIGS. 9B-9C), and in another embodiment a locking mechanism to lock the rotatable nozzle against rotation when desired is provided. In an embodiment, the same or similar interlocking swiveling nozzle 17 of device 14 as shown in FIGS. 1, 3A, 4-8 may be utilized as part of the stabilizing wand 70 of which spinning nozzle would prevent the vacuum's output hose from tangling as the rotating wand is spun or rotated. In an embodiment, the swiveling nozzle 17 may be locked against rotation by pressing the nozzle structure inwardly with respect to the wand member such that the interlocking swivel tabs impinges against a détente or thee like when rotated.

In addition, in a preferred structure, as shown in FIGS. 1, 9A-C and 10A-D, the stabilizing wand 70 comprises a handle assembly including double first and second handle components 72 and 73 which are secured to rigid conduit wand member 74. As detailed below, each handle component 72 and 73 of the handle assembly includes three connectively 90° helically placed contact points or locations 72A, 72B, 72C and 73D, 73E, 73F located around the perimeter and length of the rigid conduit wand member 74 for connecting handle components 72 and 73 to conduit member 74 (see FIGS. 10A-D). In the exemplary embodiment, each illustrated contact location 72A, B, C and 73D, E, F represents a preferred connecting location or potential connecting location for the handle components 72 and 73 with wand member 74, or a position on the perimeter of wand member 74 over which a portion of the handle components 72 and 73 is positioned The first and second handle components 72 and 73 may be secured to the rigid conduit wand member 74 by a suitable connecting arrangement such as, including but not limited to, an adhesive, mechanical connector such as a bolt, or, alternatively, the handle assembly and wand member 74 may be integrally formed as a single component by a suitable molding or 3-dimensional printing process. In an embodiment, the contact points or locations 72A, B, C and 73D, E, F may also comprise the location of nubs or short protuberances on the outer surface of the conduit member 74 which connect to the handle components 72 and 73. In an embodiment, the handle components 72 and 73 are tubular in nature wherein the outer ends of the tubular components fit over and are secured to the nubs 72A, C and 73D, F, while center nubs 72B and 73E may connect directly to a side surface of the handle components 72 and 73 or in another embodiment to an aperture in the side surface. In still another embodiment, only the ends of the first and second handle components 72 and 73 may be physically connected to the rigid conduit 74.

Figure 10:
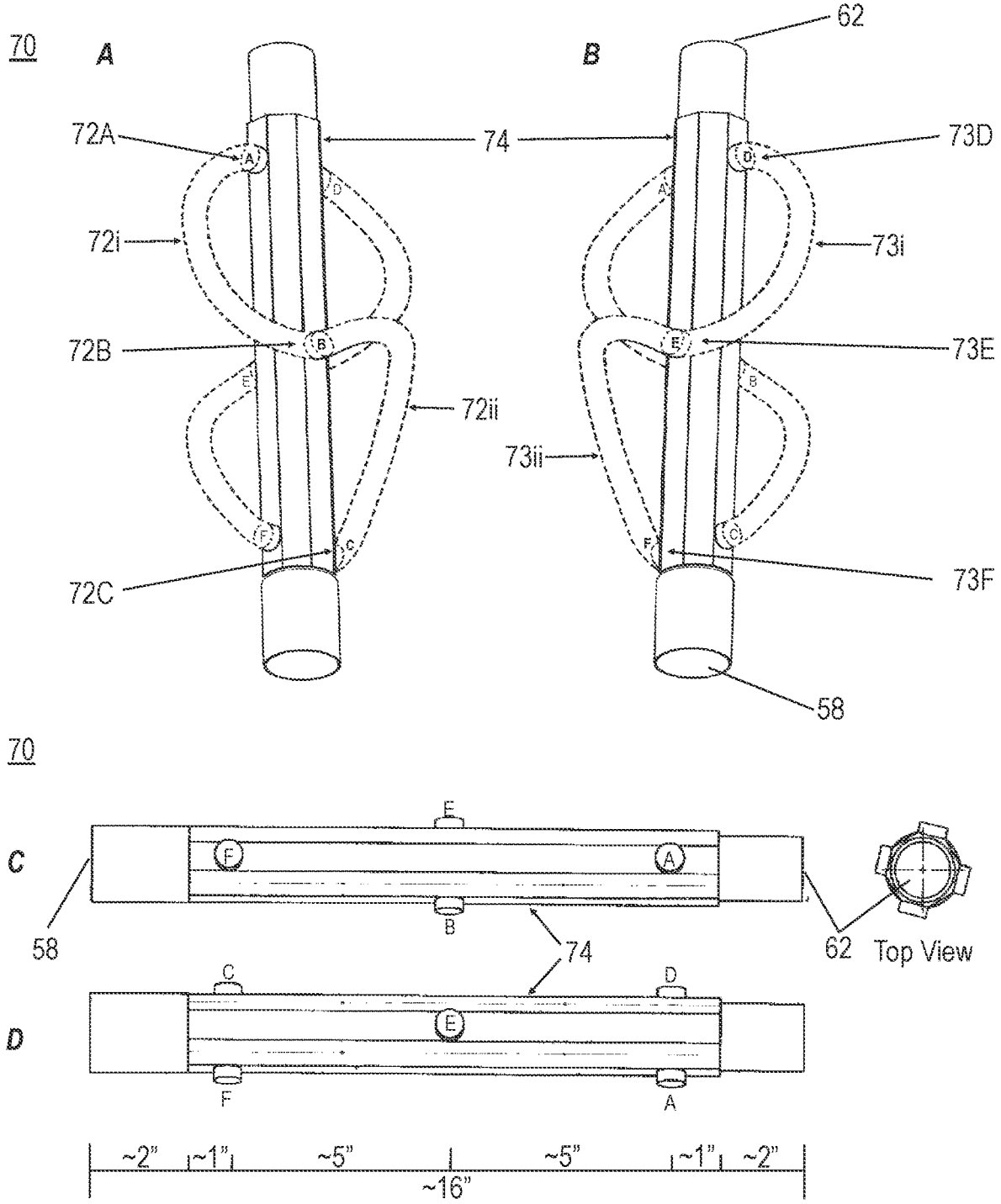
FIG. 10A is a vertical side view of the rotatable stabilizing wand in accordance with the invention in a rotational orientation similar to FIG. 9A and illustrating the contact points or locations of the offset double handle components with the rigid conduit wand section.
FIG. 10B is another vertical side view of the rotatable stabilizing wand with the rigid conduit wand section in a rotational orientation similar to FIG. 9B rotated about 90° with respect to the first orientation in FIG. 10A.
FIG. 10C is a horizontal side and top view of the rotatable stabilizing wand with the first and second offset double handle components not shown and the wand section in a first orientation illustrating the position of the contact points or location of each double handle component with the wand section and orientated to show both opposed middle contact points.
FIG. 10D is another horizontal side view of the rotatable stabilizing wand with the wand section in a second orientation rotated about 90° with respect to the first orientation in FIG. 10C and oriented to show the pairs of opposed end contact points. Estimated measurements of an embodiment of the invention are provided.
Figure 11:
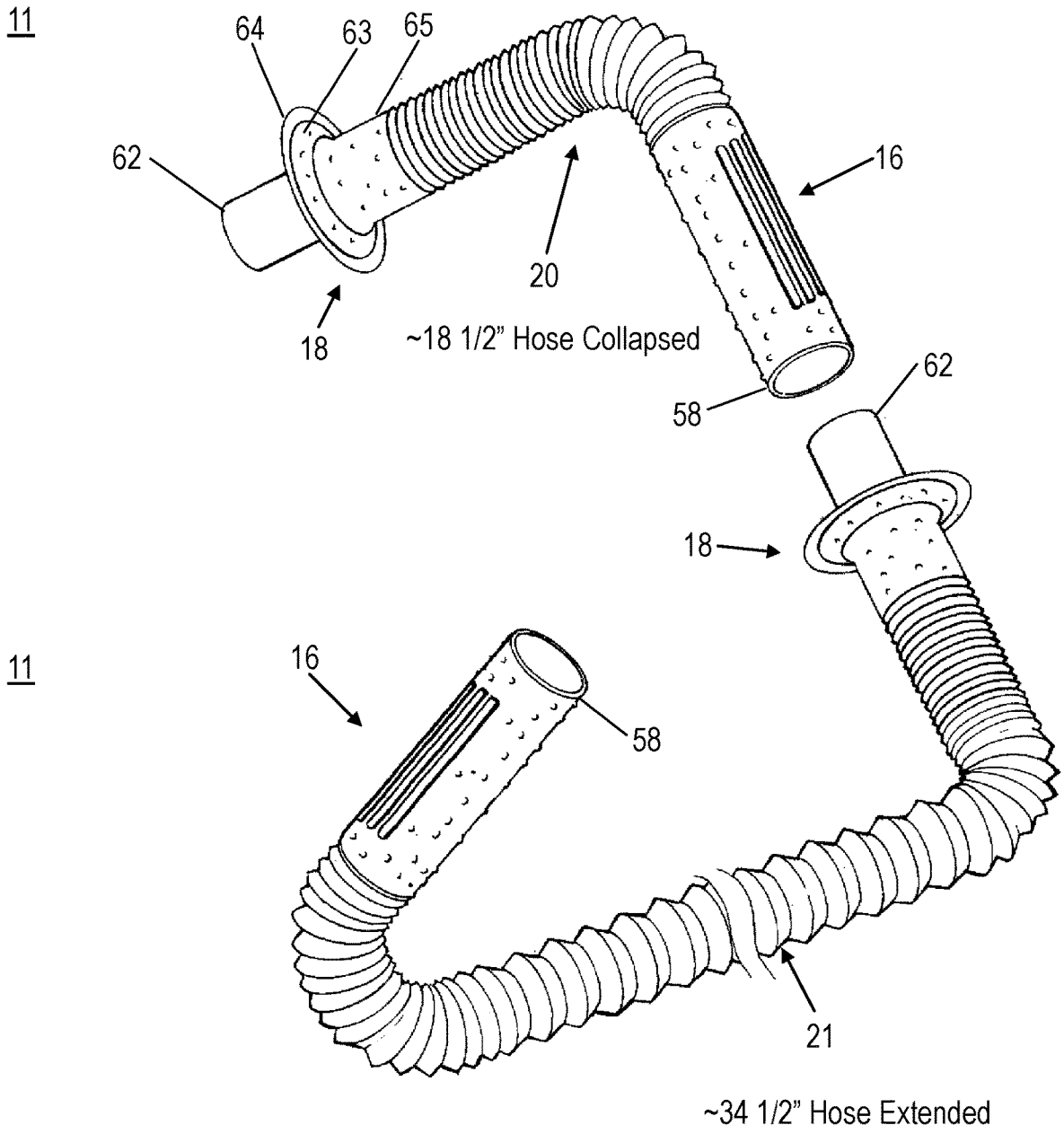
FIG. 11 illustrates an accordion hose vacuum attachment in accordance with the present invention in both partially collapsed and expanded positions and their approximate measurements.

In addition, as shown in FIGS. 10C and 10D, the contact points or locations for the first and second handle components 72 and 73 on the perimeter of the rigid wand conduit member 74 are horizontally opposite or positioned about 180° offset from the contact point or location of the alternate double handle component. More particularly, in the exemplary embodiment, contact point 72A of handle component 72 is horizontally opposite of contact point 73D of handle component 73 along a first end of wand section 74, contact point 72C of handle component 72 is horizontally opposite of contact point 73F of handle component 73 along a second end of wand section 74, and contact point 72B of handle component 72 is horizontally opposite of contact point 73E of handle component 73 along an intermediate position on wand section 74. This structural configuration provides two helically turning gripping handle portions 72*i*, 72*ii*, 73*i*, and 73*ii* on each handle component 72 and 73, connecting between pairs of contact points 72A-B, 72B-C, 73D-E, and 73 E-F. The gripping handle portions 72*i*, 72*ii*, 73*i*, and 73*ii* extend outwardly from the perimeter of rigid conduit member 74 a sufficient distance for the Consumer to grip the handle portion.

As shown in FIGS. 10A-B, gripping handle section 72*i* connects between contact points or locations 72A and 72B on wand section 74, and contact points or locations 72A and 72B are offset on the perimeter of wand section 74 by about 90°. Similarly, handle section 72*ii* connects between contact points or locations 72B and 72C on wand section 74, which contact points 72B and 72C are also offset on the perimeter of the rigid conduit member 74 by about 90°, in the same offset direction as contact points 72A and 72B. In addition, gripping handle section 73*i* connects between contact points or locations 73D and 73E on wand section 74, which contact points 73D and 73E are offset on the perimeter of rigid conduit member 74 from each other by about 90°. In addition, contact points 73D and 73E are offset from contact points 72A and 72B of handle 72 by about 90° on wand section 74, respectively. Gripping handle section 73*ii* connects between contact points or locations 73E and 73F on rigid conduit wand section 74, which contact points 73E and 73F are offset on the perimeter of wand section 74 by about 90° in the same direction as contact points 73D and 73E, and in addition are offset from contact points 72B and 72C of handle 73 by about 180° on wand section 74, respectively. In an embodiment, the handle sections 72*i*, 72*ii*, 73*i*, and 73*ii* generally have an arcuate or curved configuration. The above-described arrangement of the first and second handle components 72 and 73 of the handle assembly results in at least a partial spiraling-like formation of double pairs of handle components on the wand section 74, forming four individual offset gripping handle sections 72*i*, 72*ii*, 73*i*, and 73*ii* which provide an array of spaced apart gripping areas around the rigid conduit wand section 74 for a Consumer to grab hold off. While exemplary measurements are provided in FIG. 10D, it will be understood that the manually rotating wand 70 is not limited to any type of material, shape, size, or the placement or size of said offset handles and so forth.

Figure 9:
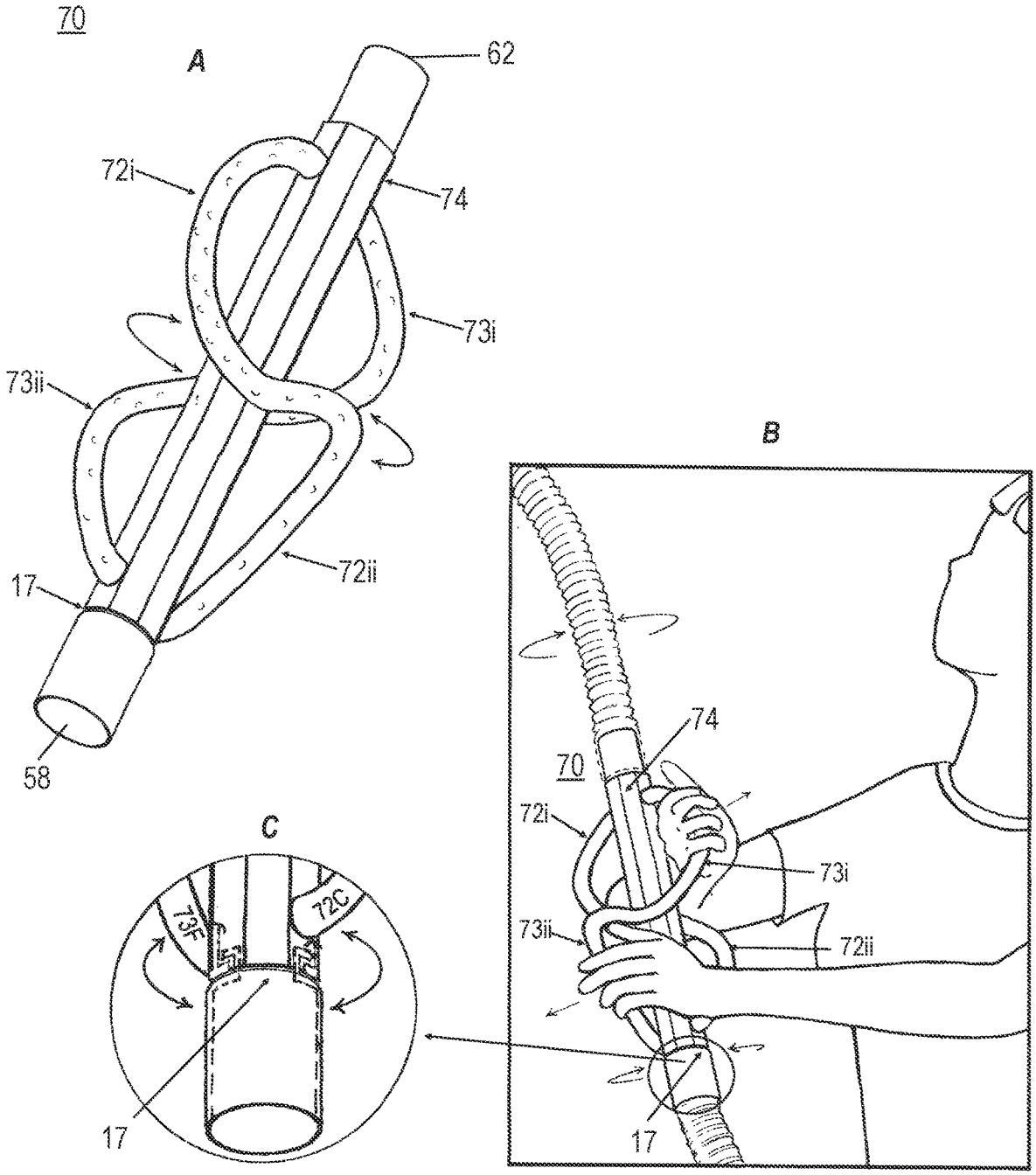
FIG. 9A illustrates an embodiment of the 360° manually rotating stabilizing wand in accordance with the invention.
FIG. 9B is an illustrative picture depiction of a Consumer manually holding and maneuvering the stabilizing wand as it is rotated 360° in either left or right directions while the handle switch from handle to handle.
FIG. 9C is an enlarged view of the 360° swivel nozzle portion of the stabilizing wand as shown in FIG. 9B.

FIG. 9B provides an illustrative example of a Consumer handling and using the stabilizing wand device 70 which also features the device 70 attached to other hose devices. FIG. 9B illustrates how the stabilizing wand device 70 allows a Consumer to spontaneously grab any offset gripping handle member 72*i*, 72*ii*, 73*i*, or 73*ii* with their hands to manually rotate device 70 in any 360° direction around the longitudinal axis of wand section 74, pull upwards/downwards for leveraging and maneuvering the rotating stabilizing wand 70 and in turn control attached devices, especially dusting attachments where aperture opening positioning is critical without bringing down the whole assembly for adjustments. This allows the Consumer superb control of all attached devices without the painful grasping of a hard circular extension rod, that is a commonly known occurrence of resulting in overall strain and pain of the hands, wrists and arms of a Consumer in not just the vacuum industry, but many other industries as well. It is believed the described improved handle arrangement would be beneficial with many tools which are used in many markets. It would be preferrable that the majority of the stabilizing wand device 70 be comprised of one or two manufactured pieces, whereby the device 70, if no spinning nozzle 17 is determined by the manufacture would be of one piece, while if a spinning nozzle is required, device 70 may be manufactured of two or more pieces. A hard plastic material that is standard in the vacuum industry would be used, but not limited to other material choices. Ideally the handles would be solid, while the center/nozzle is a straight hollow wand so vacuum suction would not be diluted by going through hollow handles. The device 70 would preferably be constructed of a hard material, but not limited to, such as a hard plastic, and covered with a padded and textured material such as TPR/PP for comfort and good grasping potential, or just the handles would be coated, possibly with TPR or other similar coating for added comfort in device usage. Although a preferred construction is illustrated in the Figures, other shapes and sizes of width/length are not limited in creating and implementing the same utility benefits, for only one such example a shape similar to a child's "silly straw" drinking straw could be used. It will be understood that whether the manually rotating wand is manufactured as one piece or several will be decided by individual manufacturers using the latest methods available and the best for the intended end use. Illustrations provided in the FIGS. 1, 9A-C and 10A-D drawings for stabilizing wand device 70 portray an 8-sided polygon center conduit or wand section 74 to best illustrate and define the location of the offset handle contact points around the perimter and length of a circular wand, although of course the center wand is not limited to the octagon-type shape. Further, FIGS. 10C-D show two sample rotations of device as well as a top view for even further elucidation of the 360° manually rotating stabilizing wand's contact points for the offset handles and their location relationship of each double handle component 72A, B, C and 73D, E, F. These two spiraling/helically pair of twisting handle components 72 and 73 create a tool that allows a Consumer to have instant access to grab an available handle portion 72*i*, 72*ii*, 73*i*, and 73*ii* as may be convenient. Illustrating the double handle components 72 and 73 in FIGS. 10A-B featuring 72A, B, C in the left view, and 73D, E, F in the right view, where each double handle component 72*i*, 72*ii*, 73*i*, and 73*ii* is composed of three 90° helically placed points of contact along the length and circumference of the rigid conduit wand section In FIG. 11, accordion hose vacuum attachment device 11 is shown, which device 11 is preferably made of a lightweight material and can be expanded, collapsed, or bent to any desired length or shape. In an embodiment, the total expansion of device 11 would be approximately two feet which is considered to be a comfortable width for a Consumer to pull out to expand or push in to collapse the accordion hose using the disk grip 18 and the handle 16. The accordion hose (shown in FIG. 11 and indicating the view 20 of the accordion hose partially collapsed and the view 21 of the accordion hose partially expanded), would be manufactured so the bellow walls would be thick enough to resist collapsing from vacuum suction while extended and to retain any bended direction placed by the Customer. A material for the hose shall have to be rigid, such as but not limited to a plastic material, but yet flexible so as to avoid cracking with repeated usage. The advantage of using the accordion hose is that it is lighter, bendable, and can telescope within its extendable manufactured length, to any length or bend desired as well as reaching specific target areas, and additional accordion hose vacuum attachments of device 11 can be coupled together to add more extension when needed, and there will always be a handle to grasp. The other advantage is that the hose collapses approximately a third of the fully extended hose making the accordion hose vacuum attachment 11 ideal for storage and carrying while cleaning as opposed to using rigid long extension hoses. Using the grip disk 18 and handle 16 makes it easier to pull outwards to expand the length of the hose and push inwards to collapse the hose, while the handle can be used to hold and direct the accordion hose.

The grip disk 18 is made of a sturdy material but is coated with soft material such as the handle 16 featuring the raised bumps and/or ridges for a slip resistant hand purchase, and the outside rim 64 is cushioned for comfort of the hand. The soft material on the disk continues as the disk diminishes to the rounded size area 63 and 65 that corresponds to the circumference of the accordion hose.

Referring again to the accordion hose vacuum attachment device 11 (FIG. 11), it should be noted that if it is attached directly behind the vacuum dusting attachment device 14, it can be raised to reach distant areas, but when close up cleaning is desired and the Consumer is handling the vacuum dusting attachment 14, the accordion hose vacuum attachment allows the Consumer a fluidity of a swinging, extension, and unobstructed movement and added distance behind the Consumer, working as well with other vacuum attachments. The hose attachment can now swing freely as compared to several rigid attachments which do not allow the same fluidity of movement As used throughout, ranges are used as shorthand for describing each and every value that is within the range. Any value within the range can be selected as the terminus of the range. In addition, all references cited herein are hereby incorporated by referenced in their entireties. In the event of a conflict in a definition in the present disclosure and that of a cited reference, the present disclosure controls.

While the present invention has been described at some length and with some particularity with respect to the several described embodiments, it is not intended that it should be limited to any such particulars or embodiments or any particular embodiment, but it is to be construed with references to the appended claims so as to provide the broadest possible interpretation of such claims in view of the prior art and, therefore, to effectively encompass the intended scope of the invention.

I claim:

1. A 360° manually rotatable stabilizing wand for use with vacuum dusting attachments comprising:

an elongated rigid wand member having an outer perimeter and including an interior suction channel having opposite open ends and defining a longitudinal axis between the opposite open ends;

a coupling nozzle connected to each of said opposite open ends of the conduit member and configured for coupling the stabilizing wand in fluid communication with a vacuum output hose connected to a suction source or a dusting attachment;

a handle assembly connected to the wand member, wherein the handle assembly comprises a first handle component and a second handle component, said first and second handle components each having an end connected to the wand member at respective first locations on the perimeter of the wand member, and another end connected to respective second locations on the perimeter of the wand member, wherein each of said first locations is spaced apart longitudinally on the wand member from the respective second locations, and each respective first and second locations are offset circumferentially around the perimeter of the wand member from one another;

said first and second handle components each having a first gripping handle portion and a second gripping handle portion extending outwardly from the wand member, wherein the respective first gripping handle portions of the first and second handle components are circumferentially offset around the perimeter of the wand member from the respective second gripping portions;

wherein the first and second handle components are additionally connected to the wand member at respective third locations, axially intermediate of said first and second locations, and the first and second handle components each form a spiral configuration about the outer perimeter of the wand member.

2. The stabilizing wand of claim 1 wherein respective first and second locations are radially on opposite sides of the wand member.

3. The stabilizing wand of claim 1 wherein the respective third locations being circumferentially offset on the perimeter of the wand member from the respective first and second locations.

4. The stabilizing wand of claim 1 wherein the gripping handle portions of the first and second handle components have a cushioned gripping surface.

5. The stabilizing wand of claim 1 wherein at least one of the coupling nozzles is rotatably connected to the wand member and is configured to connect to the vacuum output hose to prevent the output hose from tangling as the stabilizing wand is rotated.

6. The stabilizing wand of claim 5 wherein both coupling nozzles are rotatable.

7. The stabilizing wand of claim 1 wherein the respective first and second locations of the handle components are offset from one another by about 180 degrees.

8. The stabilizing wand of claim 1 wherein the third locations are circumferentially offset by about 90 degrees from each of the respective first and second locations of the handle components.

9. A 360° manually rotatable stabilizing wand for use with vacuum dusting attachments comprising:

an elongated rigid wand member having an outer perimeter and including an interior suction channel having opposite open ends and defining a longitudinal axis between the opposite open ends;

a coupling nozzle connected to each of said opposite open ends of the conduit member and configured for coupling the stabilizing wand in fluid communication with a vacuum output hose connected to a suction source or a dusting attachment;

a handle assembly connected to the wand member, wherein the handle assembly comprises a first handle component and a second handle component, said first and second handle components each having an end connected to the wand member at respective first locations on the perimeter of the wand member, and another end connected to respective second locations on the perimeter of the wand member, wherein each of said first locations is spaced apart longitudinally on the wand member from the respective second locations, and each respective first and second locations are offset circumferentially around the perimeter of the wand member from one another;

said first and second handle components each having a first gripping handle portion and a second gripping handle portion extending outwardly from the wand member, wherein the respective first gripping handle portions of the first and second handle components are circumferentially offset around the perimeter of the wand member from the respective second gripping portions;

wherein the first and second handle components are additionally connected to the wand member at respective third locations, axially intermediate of said first and second locations, and;

wherein the third locations are circumferentially offset by about 90 degrees from each of the respective first and second locations of the handle components.

10. The stabilizing wand of claim 9 wherein respective first and second locations are radially on opposite sides of the wand member.

11. The stabilizing wand of claim 9 wherein the respective third locations being circumferentially offset on the perimeter of the wand member from the respective first and second locations.

12. The stabilizing wand of claim 9 wherein the first and second handle components form a spiral configuration about the outer perimeter of the wand member.

13. The stabilizing wand of claim 9 wherein the gripping handle portions of the first and second handle components have a cushioned gripping surface.

14. The stabilizing wand of claim 9 wherein at least one of the coupling nozzles is rotatably connected to the wand member and is configured to connect to the vacuum output hose to prevent the output hose from tangling as the stabilizing wand is rotated.

15. The stabilizing wand of claim 14 wherein both coupling nozzles are rotatable.

16. The stabilizing wand of claim 9 wherein the respective first and second locations of the handle components are offset from one another by about 180 degrees.

* * * * *